US011002286B2

(12) United States Patent
Chen et al.

(10) Patent No.: US 11,002,286 B2
(45) Date of Patent: May 11, 2021

(54) VOLUTE MECHANISM OF A CENTRIFUGAL FAN

(71) Applicant: Ningbo Fotile Kitchen Ware Co., Ltd., Ningbo (CN)

(72) Inventors: Xubin Chen, Ningbo (CN); Jiansong Weng, Ningbo (CN)

(73) Assignee: Ningbo Fotile Kitchen Ware Co., Ltd., Ningbo (CN)

( * ) Notice: Subject to any disclaimer, the term of this patent is extended or adjusted under 35 U.S.C. 154(b) by 108 days.

(21) Appl. No.: 16/399,512

(22) Filed: Apr. 30, 2019

(65) Prior Publication Data

US 2019/0338784 A1 Nov. 7, 2019

(30) Foreign Application Priority Data

May 4, 2018 (CN) ..... 201810418925.6

(51) Int. Cl.
*F04D 29/42* (2006.01)
*F24C 15/20* (2006.01)
(Continued)

(52) U.S. Cl.
CPC ..... *F04D 29/4233* (2013.01); *F04D 29/281* (2013.01); *F04D 29/422* (2013.01);
(Continued)

(58) Field of Classification Search
CPC ..... F04D 29/403; F04D 29/4206; F04D 29/4233; F04D 29/281; F04D 29/422;
(Continued)

(56) References Cited

U.S. PATENT DOCUMENTS 2,001,522 A * 5/1935 Thomas ..... F04D 27/0253 415/148
2,160,666 A * 5/1939 McMahan ..... F04D 29/664 415/119
(Continued)

FOREIGN PATENT DOCUMENTS

CN 105526193 A * 4/2016
CN 108240353 A * 7/2018 ..... F04D 29/667
(Continued)

OTHER PUBLICATIONS

Li et al. CN 105526193 English Machine Translation (Year: 2016).*
Yuan et al. CN 108240357 English Machine Translation (Year: 2018).*

*Primary Examiner* — David E Sosnowski
*Assistant Examiner* — Wayne A Lambert
(74) *Attorney, Agent, or Firm* — Wang Law Firm, Inc.

(57) ABSTRACT

The present invention discloses volute for a centrifugal fan, which comprises a volute tongue having an inner wall; wherein, the volute tongue has an enclosed noise-reducing chamber, the volute tongue has a plurality of holes for allowing the air flow to enter into the noise-reducing chamber; and a sound collector and a speaker are disposed in the noise-reducing chamber. In the present invention, during the use of the centrifugal fan, a gas flow can enter the cavity through the holes on the inner wall. The sound collector can acquire a noise signal and transmit it to a controller, and the controller calculates a noise-reduced audio signal according to the acquired signal and then controls the speaker to play the corresponding reduced noise according to the noise-reduced audio signal, so that the active noise reduction is realized. With such a structure, the vortex at the volute tongue is eliminated, thus the fan noise is reduced and the fan efficiency is improved.

14 Claims, 5 Drawing Sheets

(51) Int. Cl.
*F04D 29/28* (2006.01)
*F04D 29/44* (2006.01)
*F04D 29/66* (2006.01)

(52) U.S. Cl.
CPC ..... *F04D 29/441* (2013.01); *F04D 29/663* (2013.01); *F24C 15/20* (2013.01)

(58) Field of Classification Search
CPC ..... F04D 29/44; F04D 29/441; F04D 29/663; F04D 29/4226; F04D 29/664; F04D 29/46; F04D 29/462; F04D 29/464; F04D 29/665; F24C 15/20; F05D 2260/96; F05D 2260/962
See application file for complete search history.

(56) References Cited

U.S. PATENT DOCUMENTS 2,171,342 A * 8/1939 McMahan ..... F04D 29/422 415/119
3,398,882 A * 8/1968 Zenkner ..... F04D 17/04 415/53.3
3,522,994 A * 8/1970 Zenkner ..... A47L 5/22 415/53.1
3,684,396 A * 8/1972 Ball ..... F04D 29/422 415/52.1
3,695,775 A * 10/1972 Zenkner ..... F04D 17/04 415/53.1
6,039,532 A * 3/2000 McConnell ..... F04D 29/422 415/119
6,049,615 A * 4/2000 Chou ..... G10K 11/17881 381/71.3
6,379,110 B1 * 4/2002 McCormick ..... B64C 23/00 415/119
6,935,835 B2 * 8/2005 Della Mora ..... F04D 29/422 415/119
9,380,382 B2 * 6/2016 Hopkins ..... F04D 29/665
10,415,601 B2 * 9/2019 Thawani ..... F04D 29/282
2005/0276684 A1 * 12/2005 Huang ..... F04D 29/422 415/119
2010/0028134 A1 * 2/2010 Slapak ..... G10K 11/17873 415/119
2019/0287510 A1 * 9/2019 Goto ..... F04D 29/522

FOREIGN PATENT DOCUMENTS

CN 108240357 A * 7/2018
CN 110273861 A * 9/2019
CN 110439862 A * 11/2019
DE 2030837 A1 * 12/1971 ..... F04D 29/444
DE 2210866 A1 * 9/1973 ..... F04D 17/04
DE 2545036 A * 4/1975
DE 19823575 A1 * 12/1999 ..... F04D 29/422
DE 10029546 A1 * 12/2001 ..... F04D 29/663
FR 2856442 A1 * 12/2004 ..... F04D 29/422
GB 1560117 A * 1/1980 ..... F04D 29/422
JP 05312197 A * 10/2013
WO WO-8103201 A1 * 11/1981 ..... G10K 11/172
WO WO-9302445 A1 * 2/1993 ..... F04D 29/663

* cited by examiner

VOLUTE MECHANISM OF A CENTRIFUGAL FAN

RELATE APPLICATIONS

This application claims benefit to Chinese Patent Application for a volute for a centrifugal fan, 201810418925.6, filed on May 4, 2018. The specification of the application is incorporated here by this reference.

FIELD OF THE INVENTION

The present invention relates to the technical field of range hoods, and in particular to a volute for a centrifugal fan.

DESCRIPTION OF THE PRIOR ART

For domestic range hoods, air suction and air exhaust are performed by multi-blade centrifugal fans. A fan generally consists of a volute, a motor, an impeller and the like. A tongue-like protrusion in the volute is called a volute tongue which mainly functions to isolate the flowing gas and prevent the gas from circulating in the volute. Due to the high pressure and complicated flow of gas in the vicinity of the volute tongue, the flow noise and rotation noise generated in the vicinity of the volute tongue are the main noise sources of the centrifugal fan. Therefore, reducing the noise in the vicinity of the volute tongue can significantly reduce the noise of the range hood.

Chinese Patent Application CN105526193A (Appl. No. CN201610111243.1) entitled FAN VOLUTE FOR RANGE HOOD disclosed a kind of structure of volute, including a volute tongue, wherein the volute tongue includes an inner wall of the volute tongue; the volute tongue forms an noise-reducing chamber; at least one longitudinal partition plate is arranged within the chamber in an axial direction of the volute, and a plurality of radial partition plates are arranged within the chamber in a direction perpendicular to the axis of the volute; the chamber is divided into a plurality of independent enclosed silence cavities by the longitudinal partition plate and the radial partition plates; and, a hole is formed on the inner wall of the volute tongue corresponding to each silence chamber. In the above structure, the chamber in the volute tongue is divided into a plurality of independent small enclosed cavities, and a Helmholtz resonator is formed by the small cavities and the holes formed on the corresponding sidewall. In accordance with the Helmholtz resonance principle, after the sound is transmitted, the sound waves close to the inherent frequency of the resonator resonate with the resonator. During vibration, air columns in the chamber rub against the inner wall of the chamber to consume the sound energy, realizing sound adsorption and noise reduction.

In the above structure, by providing the silence cavities, the noise of the fan is reduced to a certain extent. However, due to the small space at the volute tongue, it is difficult to completely discharge the gas at one time, and the residual gas is easy to flow back and form vortex. Consequently, the fan efficiency is reduced, and the vortex noise is generated, so that the fan still has high noise.

SUMMARY OF THE INVENTION

A technical problem to be solved by the present invention is, in view of the prior art, to provide a volute for a centrifugal fan, which reduces the fan noise and improves the fan efficiency by eliminating vortex through active noise reduction.

To solve the above technical problem, the volute for a centrifugal fan comprises a volute tongue having an inner wall, wherein the volute tongue has an enclosed noise-reducing chamber, the volute tongue has a plurality of holes on the inner wall for allowing the air flow to enter into the noise-reducing chamber; and a sound collector capable of detecting the intensity of noise and a speaker capable of playing sound are disposed in the noise-reducing chamber.

Preferably, volute tongue side plates are respectively disposed on each side of the volute tongue; a rear plate is disposed on an outer side of the volute tongue; the noise-reducing chamber is enclosed by the rear plate, the two volute tongue side plates and the outer wall of the volute tongue; and, the sound collector and the speaker are arranged facing the rear plate. This structure is advantageous for realizing better noise cancellation.

As an improvement, a baffle having an upper portion and a lower portion extending inward along the outer wall of the volute tongue is disposed inside the noise-reducing chamber; a narrow air-guiding passage is formed between the upper portion of the baffle and the corresponding outer wall of the volute tongue; the volute further comprises an air outlet, the top the air-guiding passage is in communication with the air outlet; an air-guiding chamber is enclosed by the lower portion of the baffle and the outer wall of the volute tongue; and, an opening for allowing the air flow to enter into the air-guiding chamber is formed on a bottom of the volute tongue. Preferably, a silence chamber is enclosed by the baffle and the rear plate, the baffle has a plurality of through holes for allowing the air flow from the air-guiding chamber into the silence chamber, and both the sound collector and the speaker are disposed on the baffle and located inside the silence chamber. This structure can effectively reduce gas backflow and eliminate vortex.

As a further improvement, a movable air-guiding block with a first end and a second end for removably covering the opening, is disposed inside the air-guiding chamber, and an adjustment component for controlling the air-guiding block to cover or uncover the opening according to the intensity of the air flow is disposed on the volute tongue. With such a structure, when the air volume is relatively small, the adjustment component does not work, and the conventional structure of the volute tongue can satisfy the requirements; and, when the air volume is relatively large, the adjustment component drives, under the impact of the air flow, the air-guiding block to move so as to open the opening, so that the function of eliminating vortex and reducing gas backflow is realized.

Preferably, the adjustment component comprises two pairs of connecting arms, pins and elastic members; each connecting arm is connected to the first end of the air-guiding block and rotatably connected to volute tongue side plate through one pin; the air-guiding block rotates around the pins and floats upwardly under the impact of the air flow so as to uncover the opening, the second end of the air-guiding block is a free movable end; and, the elastic member pushes the air-guiding block to be kept in a trend to cover the opening. The elastic coefficient of the elastic member can be set according to specific performance parameters such as the air pressure of the fan system and the flow. Thus, it is determined, according to the air volume, whether the opening is to be closed, to maintain the low noise of the fan.

For assembly convenience, the elastic member is a spring, the first end and the second end of the elastic member respectively resist against the top of the corresponding connecting arm and the inner wall above the elastic member. Preferably, the volute tongue has a resisting plane arranged perpendicularly to an axial direction of the spring and is formed on the inner wall above the elastic member, and the second end of the elastic member rests against the resisting plane; and, a recess for receiving the first end of the spring is formed on the top surface of each connecting arm.

Preferably, the baffle has a thickness of 1.5 mm and 2 mm, and the through holes have a diameter of 2.3 mm and 3.2 mm.

In the above solutions, the volute further comprises an annular volute wall with a first end and a second end, the volute tongue is connected to the first end of the annular volute wall; the inner wall of the volute tongue comprises a first cambered section, a second cambered section and a first planar section; the first cambered section is arranged close to an impeller of the centrifugal fan compared to the first planar section, and the bottom surface of the first cambered section serves as a first air-guiding surface of the centrifugal fan; the first planar section is arranged on the air outlet side of the volute, and its inner surface of the first planar section serves as a second air-guiding surface of the centrifugal fan; the second cambered section is connected between the first cambered section and the first planar section.

For ease of connection, the volute further comprises a front cover plate and a rear cover plate, the annular volute wall is connected between the front cover plate and the rear cover plate; an upper edge of the volute tongue is connected to an inner wall of the front cover plate and the rear cover plate, and a lower edge of the volute tongue is connected to the first end oft the annular volute wall and sealed with each other by silicone.

Preferably, the baffle comprises a second planar section and a third cambered section; the second planar section is arranged close to the first planar section; a top of the third cambered section is connected to a bottom of the second planar section; and, the third cambered section is arched toward the second cambered section, and a bottom of the third cambered section is connected to an upper surface of the first cambered section. The interval at the top of the air-guiding passage between the first planar section and the second planar section, is smaller than that of the bottom of the air-guiding passage. With the above structure, an approximately 6-shaped structure is formed by the air-guiding chamber and the long and narrow air-guiding passage, so that good effects of guiding flow and eliminating vortex are achieved.

Preferably, the bottom surface of the air-guiding block is a cambered surface protruding downward, and correspondingly, each wall of the opening is a cambered surface matching with the bottom surface of the air-guiding block. The top surface of the air-guiding block is a chambered surface protruding upward, the radian of the top surface is greater than that of bottom surface of the air-guiding block, and the connecting portion between the top surface and the bottom surface is smooth. With the above structure, the resistance to the air flow from the air-guiding block can be reduced.

Compared with the prior art, the present invention has the following advantages. Since the volute tongue in the present invention has an enclosed noise-reducing chamber, during the use of the centrifugal fan, a gas flow can enter the chamber through the holes on the inner wall of the volute tongue. The sound collector in the chamber can acquire a noise signal and transmit it to a controller, and the controller calculates a noise-reduced audio signal according to the acquired signal and then controls the speaker to play the corresponding reduced noise according to the noise-reduced audio signal, so that the active noise reduction is realized. With such a structure, the vortex at the volute tongue is eliminated, thus the fan noise is reduced and the fan efficiency is improved.

DETAILED DESCRIPTION OF THE PREFERRED EMBODIMENT

To enable a further understanding of the present invention content of the invention herein, refer to the detailed description of the invention and the accompanying drawings below:

Embodiment 1

Figure 1:
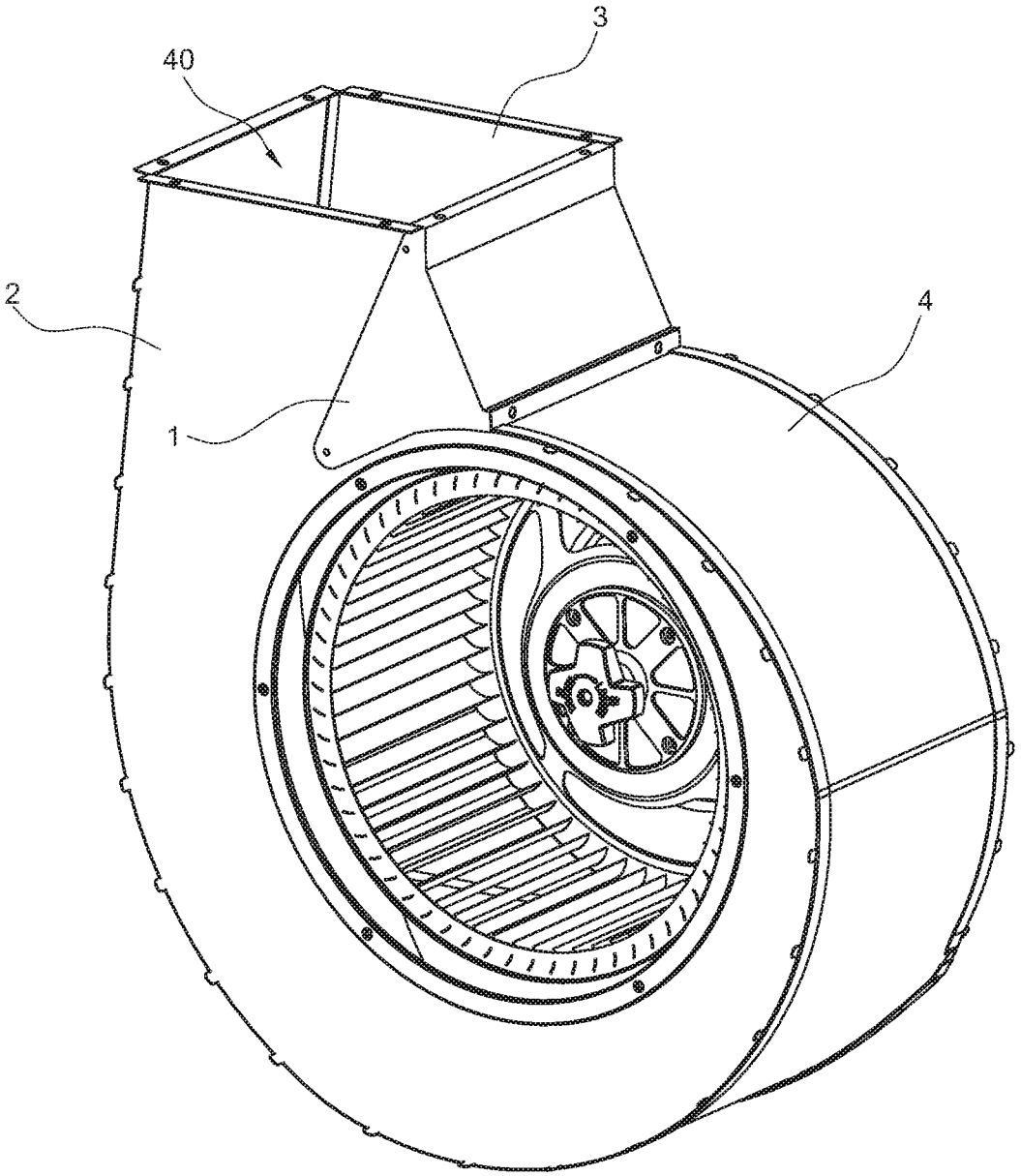
FIG. 1 is a perspective view of a volute for a centrifugal fan according to Embodiment 1 of the present invention (when an impeller is assembled)
Figure 2:
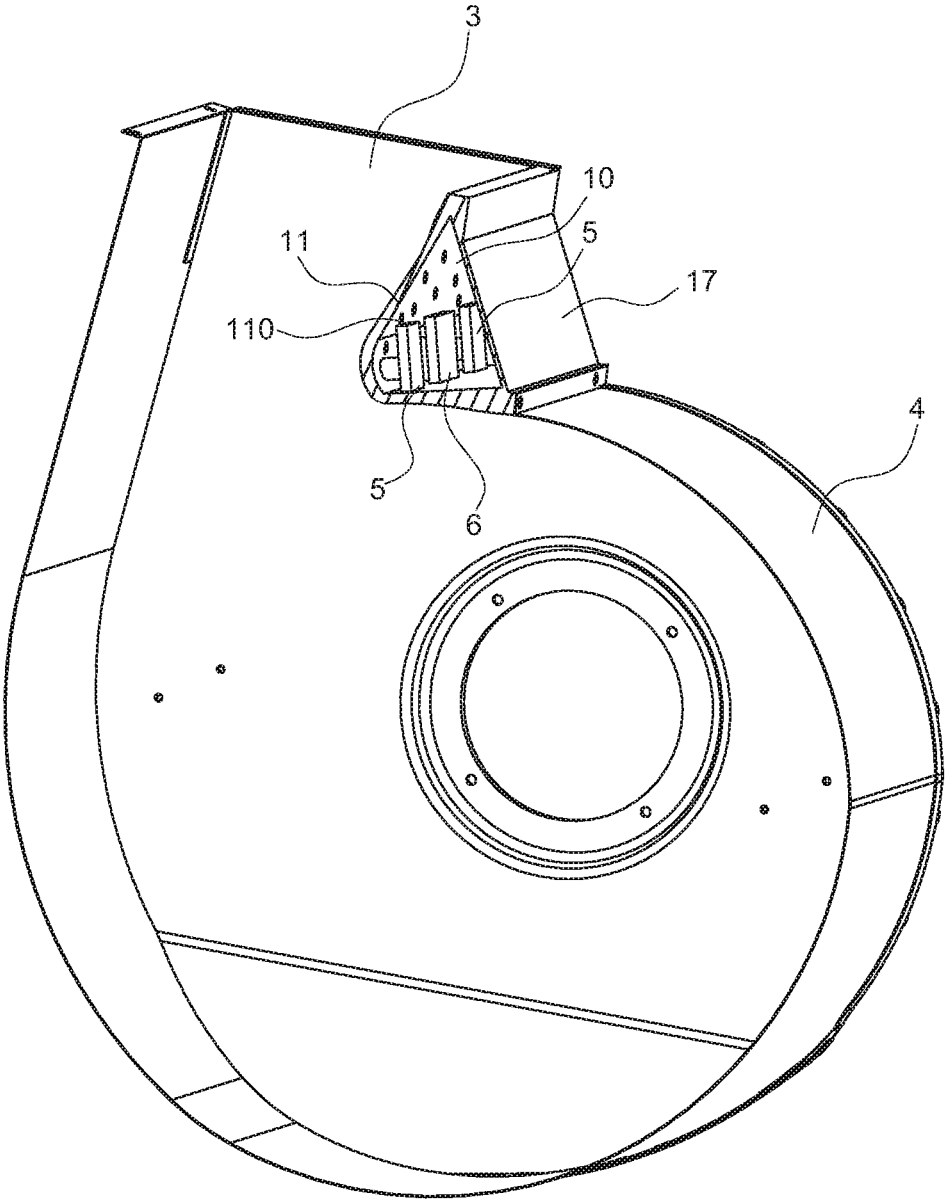
FIG. 2 is a sectional view of Embodiment 1 of the present invention.
Figure 3:
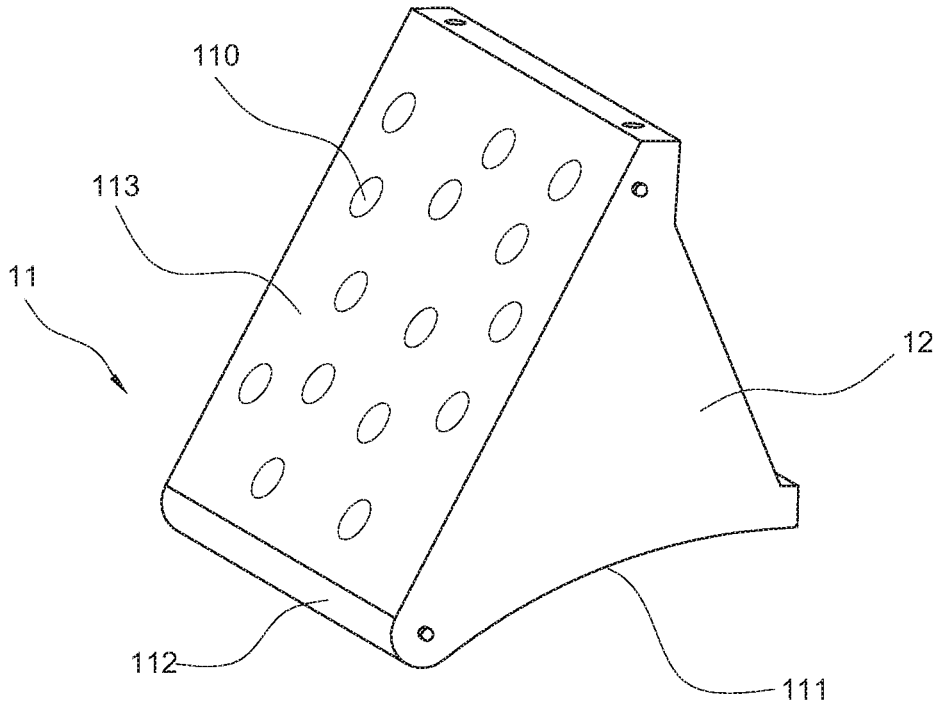
FIG. 3 is a perspective view of a volute tongue according to Embodiment 1 of the present invention, showing the structure of the volute tongue.
Figure 4:
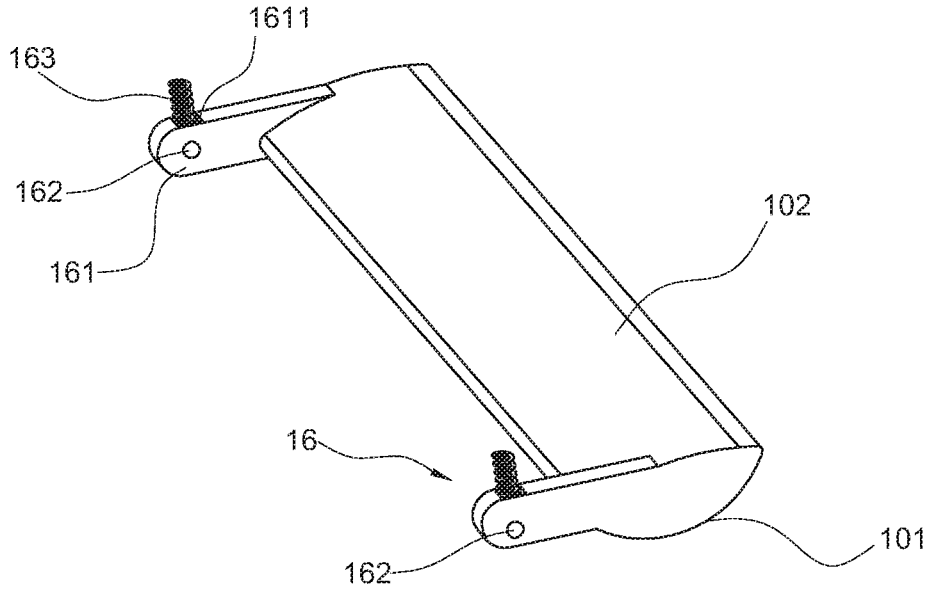
FIG. 4 is a perspective view of a air-guiding block, connecting arms and an elastic member according to Embodiment 2 of the present invention, showing the assembling structure of the air-guiding block, connecting arms and the elastic member.
Figure 5:
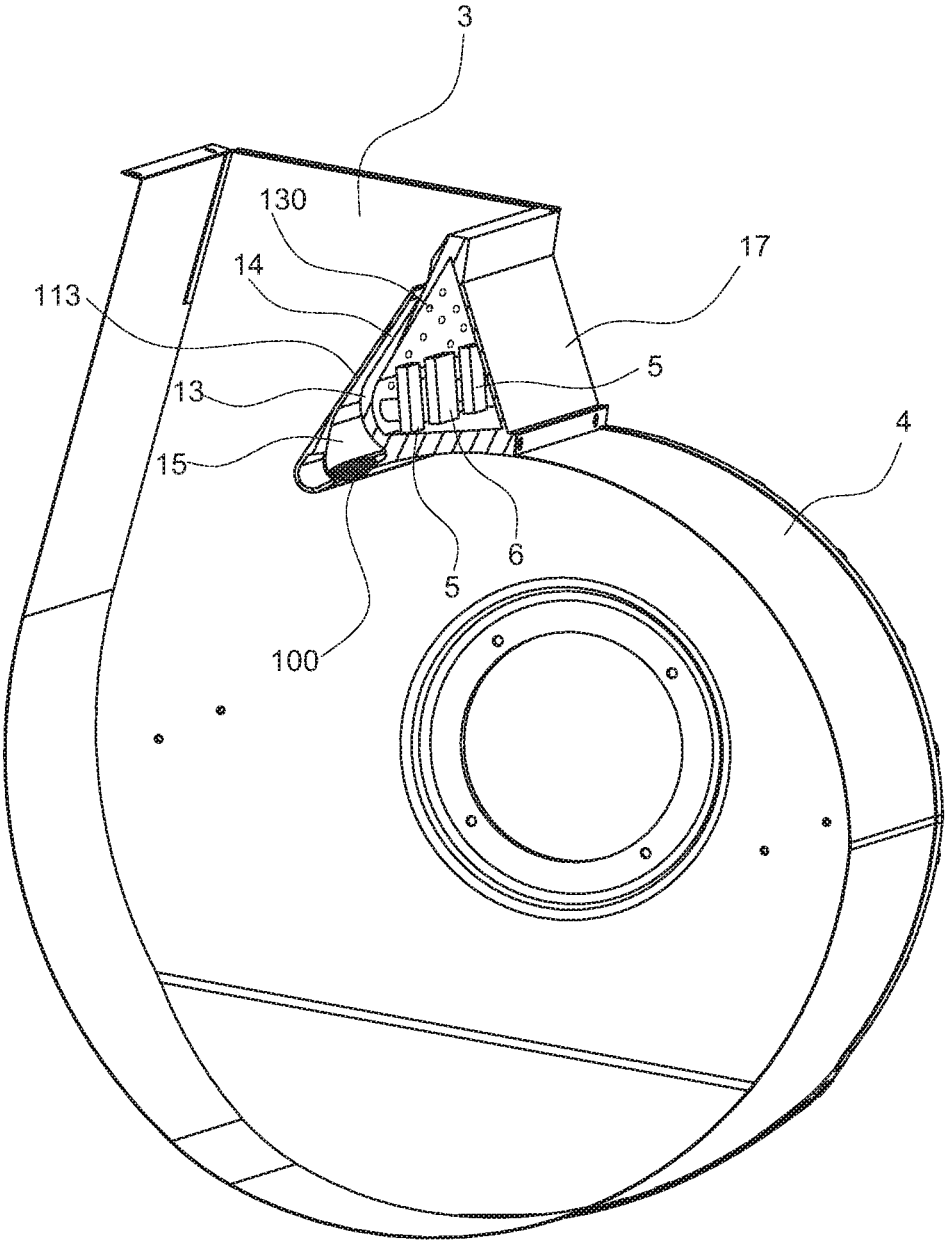
FIG. 5 is a sectional view of Embodiment 2 of the present invention.
Figure 6:
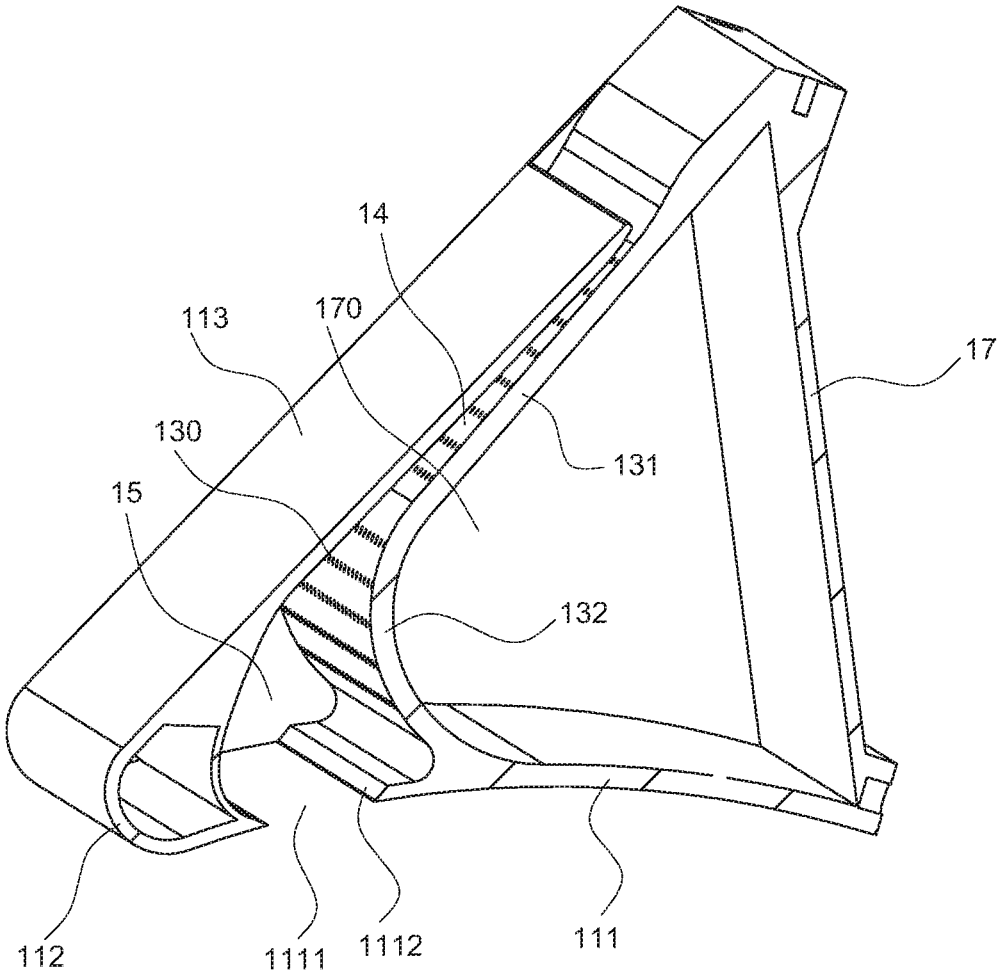
FIG. 6 is a sectional view of the volute tongue according to Embodiment 2 of the present invention (when the air-guiding block is not included).

As shown in FIGS. 1, 2 and 3, the volute for a centrifugal fan in this embodiment comprises a volute tongue 1, a front cover plate 2, a rear cover plate 3 and an annular volute wall 4 with a first end and a second end. The front cover plate 2 and the rear cover plate 3 are arranged one before the other at interval. The annular volute wall 4 is connected between the front cover plate 2 and the rear cover plate 3. The volute tongue 1 is connected to the first end of the annular volute wall 4. An air outlet 40 is enclosed by a sidewall of the volute tongue 1 opposite to the annular volute wall 4, the front cover plate 2 and the rear cover plate 3.

In this embodiment, the volute tongue 1 has an inner wall 11. The inner wall 11 of the volute tongue comprises a first cambered section 111, a second cambered section 112 and a first planar section 113. The first cambered section 111 is arranged close to an impeller of the centrifugal fan compared to the first planar section 113, and the bottom surface of the first cambered section 111 serves as a first air-guiding surface of the centrifugal fan. The first planar section 113 is arranged on the air outlet 40 side of the volute, and the inner surface of the first planar section 113 serves as a second air-guiding surface of the centrifugal fan. The second cambered section 112 is connected between the first cambered section 111 and the first planar section 113. In this embodiment, an upper edge of the volute tongue 1 is connected to upper edges of the front cover plate 2 and the rear cover plate 3 through screws, and a lower edge of the volute tongue 1 is connected to an edge of the first end of the annular volute wall 4 through a screw and sealed by silicone.

In this embodiment, the volute tongue 1 has an enclosed noise-reducing chamber 10. The volute tongue 1 has a plurality of holes 110 on the inner wall 11 for allowing the air flow to enter into the noise-reducing chamber 10. A sound collector 5 capable of detecting the intensity of noise and a speaker 6 capable of playing sound are disposed in the noise-reducing chamber 10. A corresponding controller is further disposed on the volute. The controller is connected to the sound collector 5 and the speaker 6 by an electrical signal. A noise signal acquired by the sound collector 5 is transmitted to the controller, and the controller calculates the required noise-reduced audio signal according to the noise signal and controls the speaker 6 to play the corresponding reduced noise, so as the noise reduction is realized. In this embodiment, two volute tongue side plates 12 are respectively disposed on each side of the volute tongue. A rear plate 17 is disposed at an outer side of the volute tongue 1. The noise-reducing chamber 10 is enclosed by the rear plate 17, the two volute tongue side plates 12 and the outer wall of the volute tongue. The sound collector 5 and the speaker 6 are arranged facing the rear plate 17, so it is advantageous for noise cancellation.

Embodiment 2

As shown in FIGS. 1, 4, 5 and 6, this embodiment differs from Embodiment 1 in that: in this embodiment, a baffle 13 having an upper portion and a lower portion extending inward along the outer wall of the volute tongue is disposed inside the noise-reducing chamber 10; and, the baffle 13 comprises a second planar section 131 and a third cambered section 132, the second planar section 131 is arranged close to the first planar section 113, a top of the third cambered section 132 is connected to a bottom of the second planar section 131, and the third cambered section 132 is arched toward the second cambered section 112 and a bottom of the third cambered section 132 is connected to an upper surface of the first cambered section 111. A long and narrow air-guiding passage 14 is formed between the second planar section 131 of the baffle 13 and the first planar section 113 of the inner wall 11 of the volute tongue 11, and the interval at the top of the air-guiding passage 14 is smaller than that of the bottom of the air-guiding passage 14. An air-guiding chamber 15 is enclosed by the lower portion of the baffle 13 and an inner wall of the noise-reducing chamber 10. An opening 1111 for allowing the air flow to enter into the air-guiding chamber 15 is formed on the first cambered section 111, and a movable air-guiding block 100 with a first end and a second end for removably covering the opening 1111 is further disposed inside the air-guiding chamber 15. A bottom surface of the air-guiding block 100 is a cambered surface protruding downward, and correspondingly, each wall 1112 of the opening 111 is a cambered surface matching with the bottom surface 101 of the air-guiding block 100. The top surface 102 of the air-guiding block 100 is a chambered surface protruding upward, the radian of the top surface 102 is greater than that of bottom surface 101 of the air-guiding block 100, and the connecting portion between the top surface 102 and the bottom surface 101 is smooth. With such a structure, the resistance to the air flow from the air-guiding block 100 can be reduced. In this embodiment, an approximately 6-shaped structure is formed by the air-guiding chamber 15 and the long and narrow air-guiding passage 14, so that good effects of guiding flow and eliminating vortex are achieved. The baffle 13 has a plurality of through holes 130 for allowing the air flow from the air-guiding chamber 15 into the silence chamber 170, and both the sound collector 5 and the speaker 6 are disposed on the baffle 13 and located inside the silence chamber 170. This structure can effectively reduce the gas backflow and eliminate the vortex. The baffle 13 has a thickness of 1.5 mm and 2 mm, and the through holes 130 have a diameter of 2.3 mm and 3.2 mm.

In this embodiment, a movable air-guiding block 100 with a first end and a second end for removably covering the opening 1111, is disposed inside the air-guiding chamber 15, and an adjustment component 16 for controlling the air-guiding block 100 to cover or uncover the opening 1111 according to the intensity of the air flow is disposed on the volute tongue 1. The adjustment component 16 comprises two pairs of connecting arms 161, pins 162 and elastic members 163. Each connecting arm 161 is connected to the first end of the air-guiding block 100. The other end of each connecting arm 161 is rotatably connected to the volute tongue side plate 12 through the pin 162, and the junction is close to the second cambered section 112. The air-guiding block 100 rotates around the pins 162 and floats upwardly under the impact of the air flow so as to uncover the opening 1111, the second end of the air-guiding block 100 is a free movable end. The elastic member 163 pushes the air-guiding block 100 to be kept in a trend to cover the opening 1111. The elastic coefficient of the elastic member 163 can be set according to specific performance parameters such as the air pressure of the fan system and the flow. Thus, it is determined, according to the air volume, whether the opening is to be closed, to maintain the low noise of the fan. In this embodiment, the elastic member 163 is a spring, the first end and the second end of the elastic member 163 respectively resist against the top of the corresponding connecting arm 161 and the inner wall 11 above the elastic member 163. the volute tongue 1 has a resisting plane 114 arranged perpendicularly to an axial direction of the spring and is formed on the inner wall above the elastic member 163, and the second end of the elastic member 163 rests against the resisting plane. a recess 1611 for receiving the first end of the spring is formed on the top surface of each connecting arm 161.

When in use of the volute structure in this embodiment, when the flow of the fan is small and the noise is low, the opening 1111 is closed by the air-guiding block 100; and, when the flow of the fan is large, the backflow of gas at the volute tongue 1 is increased, and the gas flow impacts the air-guiding block 100 to overcome the elasticity of the elastic member 163 and then float upward, so as to open the opening 1111. In this case, part of gas enters the air-guiding chamber 15 through the opening 1111. The part of gas entering the air-guiding chamber 15 is directly accelerated by the long and narrow air-guiding passage 14 and then discharged from the air outlet 40; and, the other part of gas enters the first chamber 170 through the through holes 130 on the baffle 130. At this time, a noise signal acquired by the sound collector 5 is transmitted to the controller, and the controller calculates the required noise-reduced audio signal according to the noise signal and controls the speaker 6 to play the corresponding reduced noise, so that the noise reduction is realized. With such a structure, the noise is reduced in an active noise reduction manner, and the secondary discharge of the backflow gas is realized, so that the gas backflow is reduced and the vortex is eliminated. Accordingly, the fan noise is reduced and the fan efficiency is improved.

The invention claimed is:

1. A volute for a centrifugal fan, comprising an air flow chamber disposed inside the volute, an air outlet attached to the air flow chamber and a volute tongue attached to the air outlet;

wherein, the volute tongue comprises a tongue body and an enclosed noise-reducing chamber, the tongue body has a plurality of holes for allowing the air flow from the air flow chamber into the noise-reducing chamber;

and a sound collector capable of detecting the intensity of noise and a speaker capable of playing sound are disposed in the noise-reducing chamber.

2. The volute of claim 1, wherein the tongue body is in L-shaped and has a vertical portion and a transverse portion;

the volute tongue further comprises two side plates respectively disposed on each side of the tongue body, and a rear plate having a top and a bottom;

the top and the bottom of the rear plate are respectively connected to the vertical portion and the transverse portion of the tongue body, and the noise-reducing chamber is enclosed by the two side plates, the rear plate and the L-shaped tongue body;

the plurality of holes are defined on the vertical portion of the tongue body, and the sound collector and the speaker both have a front side which faces the rear plate.

3. The volute of claim 2, wherein a L-shaped air-guiding plate having a vertical portion and a transverse portion is disposed adjacent to the tongue body, the two side plates both extend to the air-guiding plate;

the vertical portion of the air-guiding plate and the vertical portion of the tongue body are separated with an interval, which forms a narrow air-guiding passage, the top of the air-guiding passage is in communication with the air outlet, and the transverse portion of the air-guiding plate is connected to the transverse portion of the tongue body;

an air-guiding chamber is enclosed by the two side plates, the bottom of the vertical portion of the air-guiding plate, the transverse portion of the air-guiding plate and the vertical portion of the tongue body, the air-guiding chamber is in communication with the air-guiding passage;

an opening for allowing the air flow from the air flow chamber to enter into the air-guiding chamber is disposed on the transverse portion of the air-guiding plate.

4. The volute of claim 3, wherein a movable air-guiding block with a first end and a second end for removably covering the opening is disposed inside the air-guiding chamber, and an adjustment component for controlling the air-guiding block to cover or uncover according to the intensity of the air flow is disposed on the volute tongue.

5. The volute of claim 4, wherein the adjustment component comprises two pairs of connecting arms, pins and elastic members, each of the elastic members having a first end and a second end;

each connecting arm is connected to the first end of the air-guiding block and rotatably connected to a side plate of the two side plates through one pin;

the air-guiding block rotates around the pins, and floats upwardly under the impact of the air flow so as to uncover the opening, the second end of the air-guiding block is a free movable end;

and the elastic member pushes the air-guiding block to cover the opening.

6. The volute of claim 5, wherein the elastic member is a spring, the first end and the second end of the elastic member respectively resist against a top of the corresponding connecting arm and the air-guiding plate.

7. The volute of claim 6, wherein the air-guiding plate has a resisting plane arranged perpendicularly to the spring and is formed on the inner wall of the air-guiding plate above the elastic member, and the second end of the elastic member rests against the resisting plane; and, a recess for receiving the first end of the spring is formed on a top surface of each connecting arm.

8. The volute of claim 3, wherein the vertical portion of the tongue body has a thickness between 1.5 mm and 2 mm, and the holes have a diameter between 2.3 mm and 3.2 mm.

9. The volute of claim 2, wherein the volute further comprises an annular volute wall with a first end and a second end, the volute tongue is connected to the first end of the annular volute wall;

in the tongue body, the transverse portion is defined as a first cambered section, the vertical portion is defined as a first planar section, and the connecting portion between the transverse portion and the vertical portion is defined as a second cambered section;

the first cambered section is arranged closer to an impeller of the centrifugal fan compared to the first planar section, and the bottom surface of the first cambered section serves as a first air-guiding surface of the centrifugal fan;

the first planar section is adjacent to the air outlet of the volute, and the outer surface of the first planar section serves as a second air-guiding surface of the centrifugal fan.

10. The volute of claim 9, wherein the volute further comprises a front cover plate and a rear cover plate, the annular volute wall is connected between the front cover plate and the rear cover plate;

an edge of the vertical portion is connected to an inner wall of the front cover plate and the rear cover plate, and an edge of the transverse portion is connected to the first end of the annular volute wall and sealed with each other by silicone.

11. The volute of claim 3, wherein the volute further comprises an annular volute wall with a first end and a second end, the volute tongue is connected to the first end of the annular volute wall;

in the tongue body, the transverse portion is defined as a first cambered section, the vertical portion is defined as an upper second planar section and a lower the third cambered section;

in the air-guiding plate, the vertical portion is defined as a first planar section, and the connecting portion between the transverse portion and the vertical portion is defined as a second cambered section;

the second planar section is arranged closer to the first planar section compared to the first cambered section, the third cambered section is arched toward the air-guiding plate, and is smooth connected to the first cambered section;

the first cambered section is arranged close to an impeller of the centrifugal fan, and the bottom surface of the first cambered section serves as a first air-guiding surface of the centrifugal fan;

the first planar section is adjacent to the air outlet of the volute, and the outer surface of the first planar section serves as a second air-guiding surface of the centrifugal fan.

12. The volute of claim 11, wherein the interval at a top of the air-guiding passage is smaller than that of a bottom of the air-guiding passage.

13. The volute of claim 5, wherein a bottom surface of the air-guiding block is a cambered surface protruding downward, and correspondingly, each wall of the opening on the transverse portion is a cambered surface matching with the bottom surface of the air-guiding block.

14. The volute of claim 13, wherein a top surface of the air-guiding block is a chambered surface protruding upward, the radian of the top surface is greater than that of the bottom surface of the air-guiding block, and a connecting portion between the top surface and the bottom surface is smooth.

* * * * *